US006032639A

United States Patent [19]

Goto et al.

[11] Patent Number: 6,032,639

[45] Date of Patent: Mar. 7, 2000

[54] DIAGNOSIS FOR FUEL SYSTEM OF INTERNAL COMBUSTION ENGINE

[75] Inventors: Kenichi Goto, Kanagawa; Hideyuki Tamura, Yokohama, both of Japan

[73] Assignee: Nissan Motor Co., Ltd., Yokohama, Japan

[21] Appl. No.: 09/140,326

[22] Filed: Aug. 26, 1998

[30] Foreign Application Priority Data

Aug. 28, 1997 [JP] Japan ..... 9-232007

[51] Int. Cl.[7] ..... F02D 41/22; F02B 17/00

[52] U.S. Cl. ..... 123/295; 123/359; 123/479; 123/690

[58] Field of Search ..... 123/295, 479, 123/690, 198 D, 359; 73/119 A

[56] References Cited

U.S. PATENT DOCUMENTS

| | | | |
|---|---|---|---|
| 5,493,902 | 2/1996 | Glidewell et al. | 123/479 |
| 5,617,337 | 4/1997 | Eidler et al. | 364/551.01 |
| 5,723,780 | 3/1998 | Miwa et al. | 73/119 A |
| 5,738,063 | 4/1998 | Pfuhl et al. | 123/198 D |
| 5,937,822 | 8/1999 | Nakajima | 123/295 |

FOREIGN PATENT DOCUMENTS

| | | |
|---|---|---|
| 5-069374 | 9/1993 | Japan . |
| 5-321783 | 12/1993 | Japan . |

OTHER PUBLICATIONS

"Toyota Corona Premio", New Model Manual, (1996), pp. 1–59 (No translation).

*Primary Examiner*—Tony M. Argenbright
*Assistant Examiner*—Arnold Castro
*Attorney, Agent, or Firm*—Foley & Lardner

[57] ABSTRACT

A diagnostic system for a fuel system of an internal combustion engine such as direct-injection gasoline engine monitors a pressure deviation of a actual fuel pressure sensed by a fuel pressure sensor from a desired fuel pressure in a feedback fuel pressure control, and thereby detects abnormality in the fuel system. When the pressure deviation continues to be outside a normal range, a diagnostic controller commands engine operation in a homogeneous stoichiometric combustion mode, and monitors a feedback correction quantity in a feedback stoichiometric air fuel control during the engine operation in the homogeneous stoichiometric combustion mode. The controller attributes the abnormality to the fuel pressure sensor if the feedback correction quantity of the air fuel ratio is fixed to an upper limit or a lower limit.

20 Claims, 6 Drawing Sheets

DIAGNOSIS FOR FUEL SYSTEM OF INTERNAL COMBUSTION ENGINE

BACKGROUND OF THE INVENTION

The present invention relates to an internal combustion engine, and more specifically to a diagnostic system or method for a feedback fuel pressure control system for an engine, such as a direct injection type engine or a lean burn engine.

Recently, the technique of in-cylinder direct fuel injection in a spark ignition engine such as a gasoline engine is under development to improve the fuel efficiency by selectively using stratified charge combustion in a partial load region. In a conventional engine of a type injecting gasoline into the intake port, the air fuel mixture is transported to the combustion chamber. By contrast, a direct injection type engine can avoid adverse influence of transportation (distance/velocity) lag of fuel, on transient driving performance, and emission performance.

A direct injection engine of one conventional example is equipped with a high pressure fuel pump for increasing the fuel pressure for efficient fuel atomization, and a fuel pressure sensor used for feedback-controlling the fuel pressure to a desired fuel pressure determined in accordance with engine operating conditions. (as disclosed in Japanese Utility Model Provisional (Kokai) Publication No. 5(1993)-69374; "TOYOTA CORONA PREMIO", New Model Manual, September 1996, pages 1~59; or Japanese Patent Provisional (Kokai) Publication No. 5(1993)-321783).

SUMMARY OF THE INVENTION

It is an object of the present invention to provide diagnostic method and system capable of making accurate diagnosis on a fuel system for an internal combustion engine.

Specifically, the diagnostic method and system according to the present invention is arranged to discriminate various malfunctions beyond conventional detection of decisive failure such as wire disconnection or short-circuit in circuitry of a fuel pressure sensor and a driving solenoid for a fuel pump in a conventional diagnostic system.

According to the present invention, a diagnostic control method or system (or apparatus) for detecting malfunction in a fuel system for an internal combustion engine, comprises;

- a constituent element for sensing an actual fuel pressure;
- a pressure controlling element of performing a feedback fuel pressure control to reduce a pressure deviation of the sensed actual fuel pressure from a desired fuel pressure;
- an abnormality detecting element of detecting abnormality in the fuel system by monitoring the actual fuel pressure;
- a richer combustion mode effecting element of effecting a feedback air fuel ratio control in a richer combustion mode such as a homogeneous stoichiometric charge combustion mode if the abnormality is detected; and
- a diagnosing element of judging whether or not the abnormality is attributable to the process of fuel pressure sensing, by monitoring performance of the feedback air fuel control during the engine operation in the richer combustion mode.

This diagnostic control method or system can accurately detect malfunction in the fuel system by monitoring behavior in both the fuel pressure control system and the air fuel ratio control system, so that the system can readily protect the driveability against abnormal conditions and reduce the time required for repair.

DETAILED DESCRIPTION OF THE INVENTION

Figure 1:
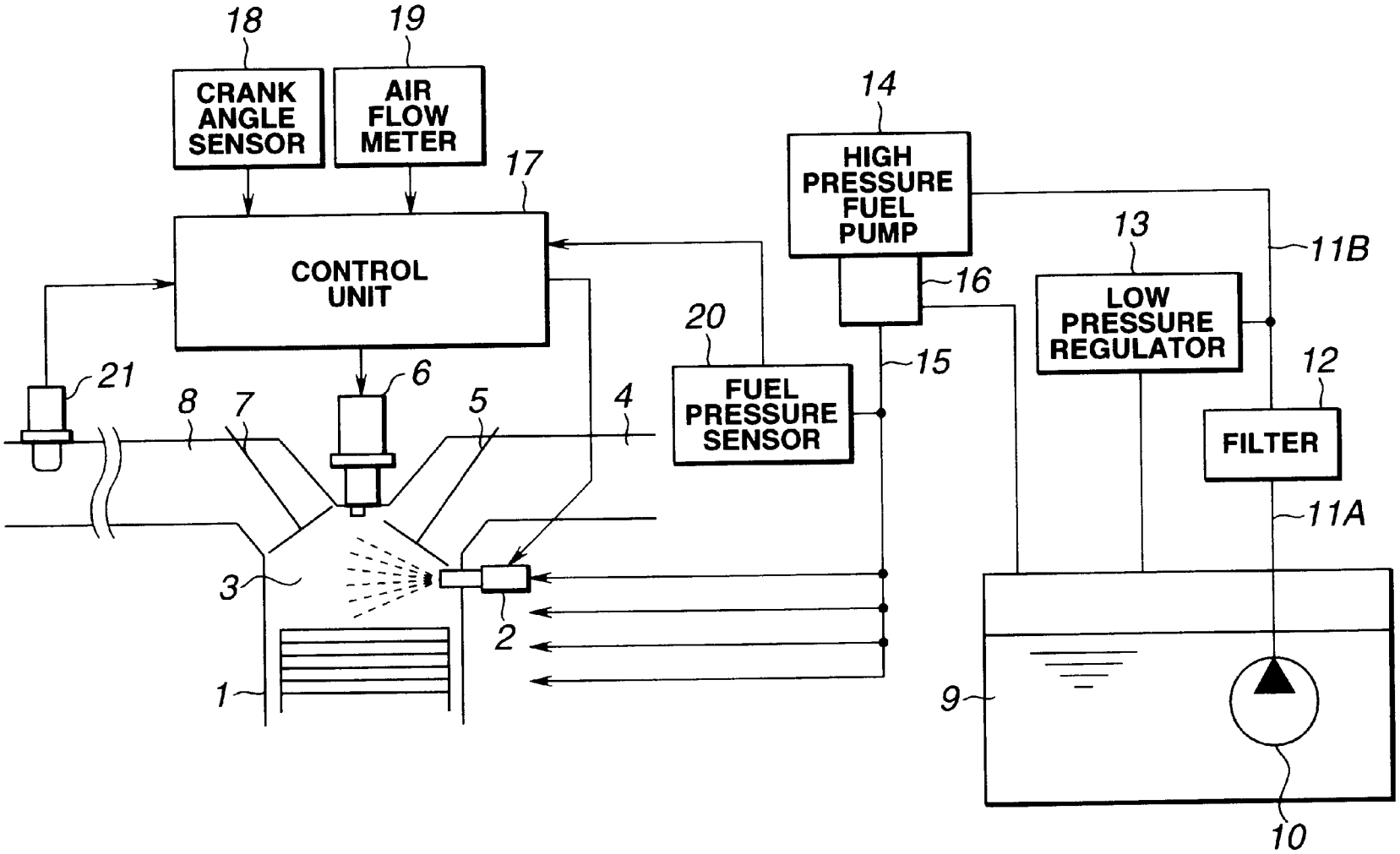
FIG. 1 is a schematic view showing an engine system according to one embodiment of the present invention.

FIG. 1 shows an engine system according to one embodiment of the present invention. The engine system comprises an internal combustion engine 1 as a main component, and other components. In this example, the engine 1 is used as a prime mover for a vehicle.

As shown in FIG. 1, the engine 1 is provided, for each cylinder, with a solenoid-operated fuel injector 2 for injecting fuel directly into a combustion chamber 3, at least one intake port 4 having an intake valve 5, a spark plug 6, and at least one exhaust port 8 having an exhaust valve 7.

In this example, the engine 1 is a direct injection type spark ignition internal combustion engine. The fuel injector 2 produces an air fuel mixture by injecting fuel into fresh intake air introduced into the combustion chamber 3 through the intake port 4 and the intake valve 5, and the spark plug 6 ignites the air fuel mixture by means of an electric spark. Exhaust gas is carried away from the combustion chamber 3 through the exhaust port 8 and the exhaust valve 7, and discharged to the outside through a catalytic converter and a muffler.

In this example, a combustion mode of the engine 1 is changed over between a stratified charge combustion mode and a homogeneous charge combustion mode. In the stratified combustion mode, the injector 2 injects fuel during the compression stroke so as to produce a stratified combustible mixture closely around the spark plug 6. In the homogeneous combustion mode, fuel is injected during the intake stroke so as to produce a homogeneous air fuel mixture. This engine system changes over the combustion mode between the stratified combustion mode and the homogeneous combustion mode in accordance with one or more engine operating conditions.

A low pressure fuel pump (or first fuel pump) 10 draws fuel from a fuel tank 9 and supplies fuel under relatively low pressure to a high pressure fuel pump (or second fuel pump) 14 through a fuel filter 12 disposed in a lower pressure fuel passage at a position dividing the lower pressure fuel passage into an upstream section 11A extending from the first pump 10 to the filter 12, and an upstream section 11B extending from the filter 12 to the high pressure fuel pump 14. A low pressure regulator 13 is disposed in a fuel passage branching off from the downstream passage section 11B and extending to the fuel tank 9. By the low pressure regulator 13, the pressure of the fuel supplied to the high pressure fuel pump 14 is held at a predetermined constant low pressure.

The high pressure fuel pump 14 of this example is driven by a crank shaft or a cam shaft of the engine 1 directly or through gearing or a belt. The high pressure fuel pump 14 receives the lower pressure fuel through the fuel passage section 11B from the low pressure pump 10, and increases the fuel pressure to a high pressure level. A high pressure regulator 16 controls the pressure of the fuel discharged into a high pressure fuel passage 15 from the high pressure pump 14, and thereby serves as a controlling element of a fuel pressure control system for controlling the fuel pressure supplied to the fuel injector 2. In this example, the high pressure regulator 16 is combined with the high pressure pump 14 into a single unit. The high pressure fuel passage 15 supplies the fuel under the controlled pressure to each fuel injector 2. The high pressure regulator 16 of this example has a duty solenoid. This fuel system can control the fuel pressure supplied to the injectors 2 to a desired fuel pressure by controlling a duty ratio of the duty solenoid in a manner of a duty factor control system.

A control unit 17 controls each injector 2 by sending a pulse signal having a controlled pulse width determined in accordance with one or more engine operating conditions. In response to the pulse signal, each injector 2 injects the fuel of the pressure controlled at the desired fuel pressure, into the corresponding combustion chamber 3 at the fuel injection timing. The control unit 17 of this example includes, as a main component, a microcomputer.

Input information needed by the control unit 17 is collected by an input section. The input section comprises input devices for collecting input information by sensing various operating conditions of the engine and the vehicle or by receiving driver's command. From the input section, the control unit 17 receives information for various control operations. In the example shown in FIG. 1, the input section comprises a crank angle sensor 18 for sensing the crank angle of the engine 1, an air flow meter (or air flow sensor) 19 for sensing an intake air quantity, a fuel pressure sensor 20, and an air fuel ratio sensor (or oxygen sensor) 21 disposed on the downstream side of the exhaust manifold, for sensing the oxygen content in the exhaust gas to determine an actual air fuel ratio. The crank angle sensor 18 is used for sensing the engine speed for the fuel injection control. The crank angle sensor 18 is further used for sensing the revolution speed of the high pressure fuel pump 14. The fuel pressure sensor 20 senses the fuel pressure in the high pressure fuel passage 15 extending from the high pressure pump 14 to the injectors 2. Signals produces by these sensors are delivered to the control unit 17.

In accordance with the input information, the control unit 17 controls the fuel injection quantity by controlling the pulse width of the fuel injection pulse signal to each injector 2, and further controls the fuel injection timing.

Figure 3:
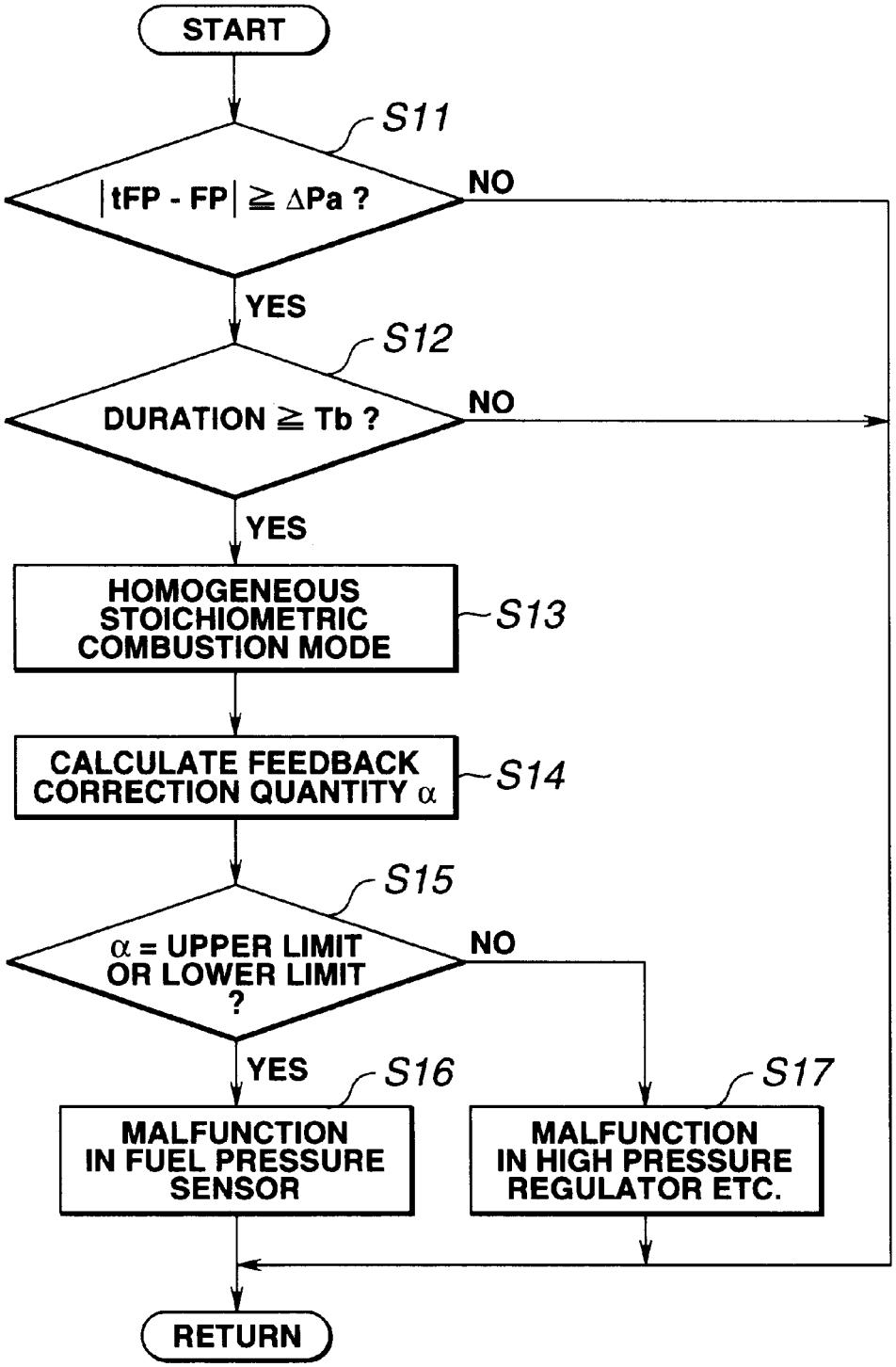
FIG. 3 is a flowchart of a diagnosis routine performed by the control unit of FIG. 1.

The control unit 17 further control the fuel pressure as shown in FIG. 3.

Figure 2:
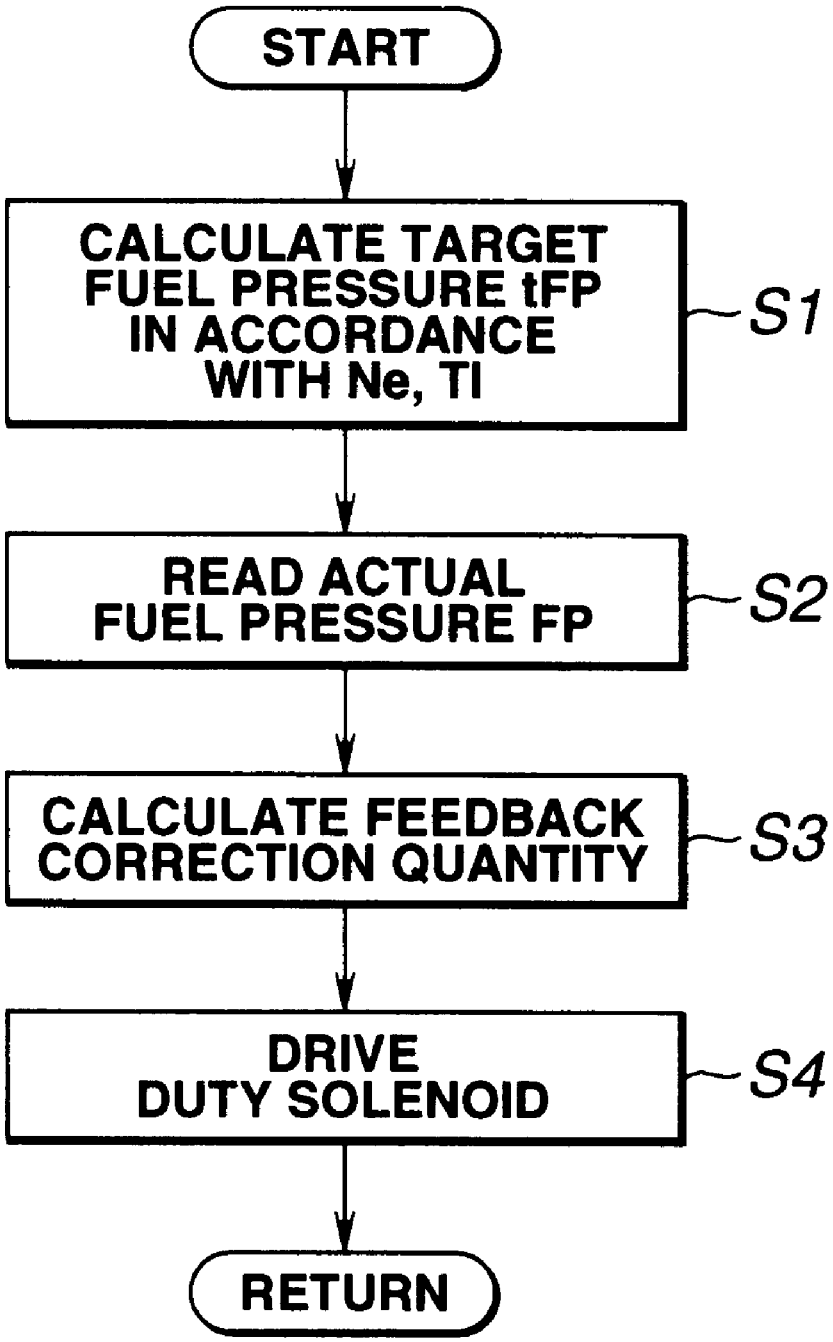
FIG. 2 is a flowchart of a feedback fuel pressure control routine performed by a control unit in the engine system of FIG. 1.

FIG. 2 shows a feedback fuel pressure control routine.

At a step S1, the control unit 17 calculates a desired target fuel pressure tFP in accordance with the engine speed Ne and an engine operating parameter, such as a fuel injection quantity TI, indicative of an engine load.

At a step S2, the control unit 17 reads an actual fuel pressure FP sensed by the fuel pressure sensor 20.

At a step S3, the control unit 17 determines a pressure deviation ΔP of the actual fuel pressure FP from the desired fuel pressure tFP, and further calculates, from the pressure deviation, a feedback pressure control quantity according to a predetermined control law (or control action) such as a PID control law.

At a step S4, the control unit 17 produces a fuel pressure control signal representing the feedback fuel pressure control quantity, and sends the fuel pressure control signal to the duty solenoid in the high pressure regulator 16 of the high pressure fuel pump 14. The discharge fuel quantity is thus controlled in accordance with the feedback pressure control quantity. In this example, a feedback fuel pressure control system is formed by the control unit 17, the fuel pressure sensor 20 and the high pressure regulator 16 at least.

FIG. 3 shows a diagnosis routine for detecting abnormal conditions in the fuel system.

At a step S11, the control unit 17 determines whether the pressure deviation ΔP of the actual fuel pressure FP sensed by the fuel pressure sensor 20 from the desired fuel pressure tFP is equal to or greater than a predetermined pressure deviation value ΔPa.

When the pressure deviation is equal to or greater than the predetermined deviation value ΔPa, then the control unit 17 proceeds from the step S11 to a step S12. At the step S512, the control unit determined whether this condition in which the pressure deviation is equal to or greater than the predetermined deviation value ΔPa continues for a time duration equal to or longer than a predetermined time length Tb.

If the duration of this condition of the excessive pressure deviation is equal to or longer than the predetermined time length Tb, then the control unit 17 judges that there exists abnormality in the fuel system, and proceeds from the step S12 to a step S13.

At the step S13, the control unit 17 commands an engine operation in a homogeneous stoichiometric combustion mode in which the air fuel ratio is feedback-controlled to a theoretical air fuel ratio in accordance with the air fuel ratio sensed by the air fuel ratio sensor 16. Therefore, the engine 1 is operated in the homogeneous stoichiometric combustion mode. If the engine operation before the step S13 is in the stratified combustion mode, for example, the control unit 17 forcibly changes over the combustion mode, at the step S13, from the stratified combustion mode to the homogeneous stoichiometric combustion mode. The control system according to this embodiment effects the homogeneous stoichiometric combustion mode in order to locate abnormal conditions as mentioned later, and further in order to maintain stable driveability. The stratified charge combustion is readily affected by abnormality in the fuel system whereas the homogeneous combustion can provide more stable combustion.

At a step S14, the control unit 17 determines a feedback correction quantity α of the feedback air fuel ratio control in the homogeneous stoichiometric combustion mode. The feedback air fuel ratio correction quantity α is determined according to a predetermined control law (or control action) such as I control law or PI control law.

At a step S15, the control unit 17 determines whether the feedback air fuel ratio correction quantity α is in a condition sticking to an upper limit value (125%, for example) or a lower limit value (75%, for example) on either side of a reference value (100%) corresponding to the theoretical air fuel ratio.

If the feedback correction quantity α is equal to the upper or lower limit value, the control unit 17 proceeds to a step S16, and judges that there is a malfunction in the pressure sensor 20. When the sensor signal produced by the fuel pressure sensor 20 is abnormal, the fuel injection quantity calculated from the abnormal sensor signal is not correct, and the control system is unable to control the fuel injection quantity properly. Therefore, the control system increases or decreases the feedback correction quantity α in a direction to correct the error. As a result, the feedback correction quantity α sticks to, or is held persistently equal to, the upper or lower limit.

When the feedback correction quantity α oscillates on both sides of a middle value without sticking to the upper or lower limit, the control unit 17 judges that there is no abnormality in the fuel pressure sensor 20, and that the feedback air fuel control is normal, and proceeds from the step S15 to a step S17 to judges that the abnormality is attributable to a malfunction in the high pressure regulator 16, or bad contact of a connector in wiring harness or some other causes.

Abnormality in the fuel pressure control system affects control performance of the air fuel ratio control system. By examining this relationship, this control system presumes that the fuel pressure sensor is still functioning properly if the feedback stoichiometric air fuel ratio control is still in an allowable range.

This engine system can maintain the stability of the combustion by changing over the combustion mode from the stratified charge combustion mode, a homogeneous lean combustion mode or some other lean combustion mode, to the homogeneous stoichiometric combustion mode when an abnormal condition is detected in the fuel system. Moreover, the control system can discriminate a malfunction in the fuel pressure sensor 20 from a malfunction not attributable to the fuel pressure sensor 20 by monitoring the feedback air fuel ratio correction quantity in the homogeneous stoichiometric mode. Therefore, this system can reduce the time required for repair.

The predetermined deviation value ΔPa used in the step S11 to determine whether the actual fuel pressure FP is settled down to the desired fuel pressure tFP may be varied in accordance with the desired fuel pressure tFP. When the desired fuel pressure is high, the differential pressure (or pressure deviation) of the actual fuel pressure from the desired fuel pressure tends to increase. Therefore, the predetermined deviation value ΔPa is increased when the desired fuel pressure is higher, and the predetermined deviation value ΔPa is decreased when the desired fuel pressure is lower. By adjusting the predetermined deviation value ΔPa in this way, the control system can accurately detect settlement or unsettlement of the fuel pressure.

Instead of the diagnostic check in the step S15 shown in FIG. 3, it is possible to perform a diagnostic operation by checking the combination of the positive or negative sign of the pressure deviation ΔP (=tFP−FP), and the positive or negative sign of a deviation (α−1) of the feedback correction quantity α from a reference value 1. In this case, the control system performs the feedback fuel pressure control, but the control system does not perform the correction (or modification) of the basic fuel injection quantity Tp based on the sensed fuel pressure.

When the fuel pressure sensor 20 is abnormal, and the sensed value is stuck to an upper or lower limit value, the pressure deviation ΔP (=tFP−FP) is persistently held negative or positive, and the feedback fuel pressure control based on this erroneous sensed fuel pressure causes a decrease or increase of the actual fuel pressure. In response to the decrease or increase of the actual fuel pressure, the feedback air fuel correction quantity α is increased or decreased to restrain changes in the fuel injection quantity, and the deviation (α−1) becomes positive or negative. Therefore, the control unit 17 judges that there is an abnormal condition to fix the sensed value of the fuel pressure sensor 20 to the upper limit value when the pressure deviation (tFP−FP) is negative and the deviation (α−1) is positive. When the deviation (tFP−FP) is positive and the deviation (α−1) is negative, the control unit 17 judges that there arises an abnormal condition fixing the sensed value of the fuel pressure sensor 20 to the lower limit value.

If, on the other hand, the control duty DUTY for the high pressure regulator 16 is fixed to the opening valve side, the actual fuel pressure FP decreases below the desired fuel pressure tFP and the deviation (tFP−FP) becomes positive. In response to this decrease in the actual fuel pressure FP, the basic fuel injection quantity Tp is decreased, the feedback air fuel ratio correction quantity α is increased and the deviation (α−1) becomes positive.

If the control duty DUTY is fixed to the closing valve side, the actual fuel pressure FP increases above the desired fuel pressure tFP and the deviation (tFP−FP) becomes negative. In response to this increase in the actual fuel pressure FP, the basic fuel injection quantity Tp is increased, the feedback air fuel ratio correction quantity α is decreased and the deviation (α−1) becomes negative.

Therefore, the control system judges that there is an abnormal condition fixing the high pressure regulator 16 to the opening side when the deviation (tFP−FP) is positive and the deviation (α−1) is positive, too. When the deviation (tFP−FP) and the deviation (α−1) are both negative, the control system judges that there is an abnormal condition fixing the high pressure regulator 16 to the closing side.

Figure 4:
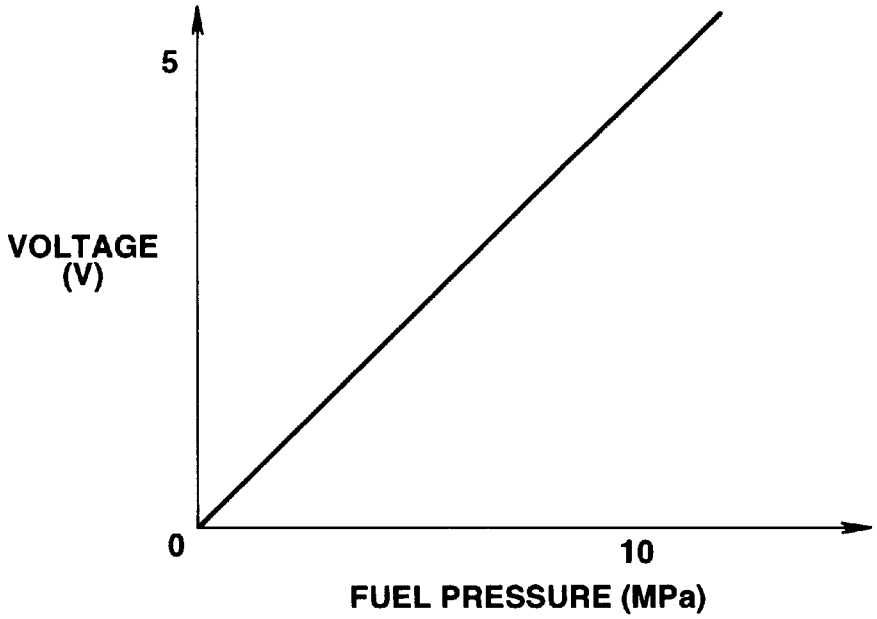
FIG. 4 is a graph showing a characteristic of a fuel pressure sensor in the engine system of FIG. 1.
Figure 5:
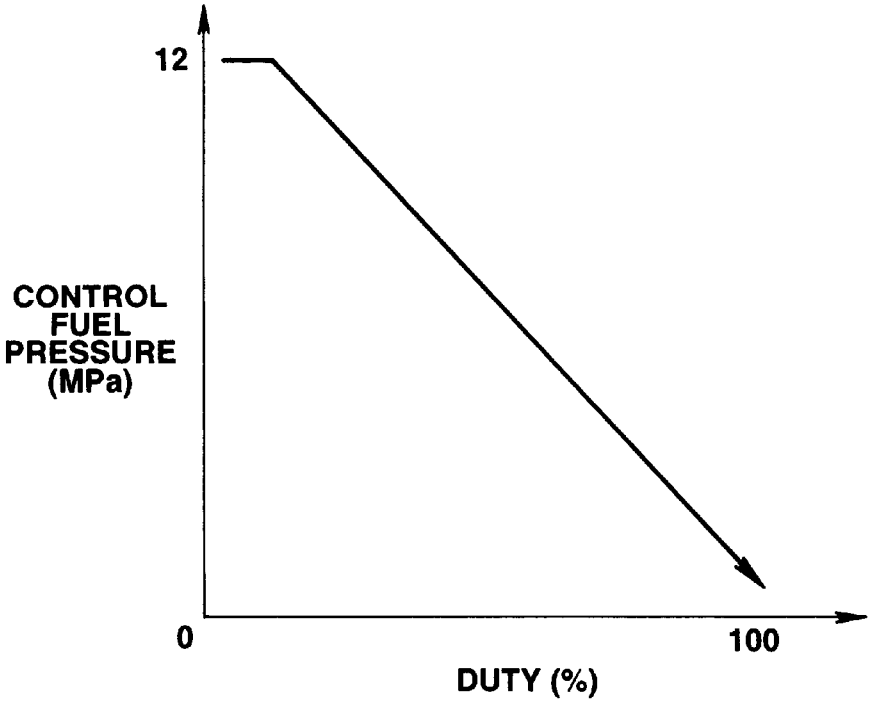
FIG. 5 is a graph showing a basic characteristic of a high pressure regulator in the engine system of FIG. 1.

The fuel pressure sensor 20 of the illustrated example produce a voltage signal according to a characteristic shown in FIG. 4. The high pressure regulator 16 varies the controlled fuel pressure in accordance with the duty ratio (%) of the solenoid energizing drive signal as shown in FIG. 5.

Figure 6:
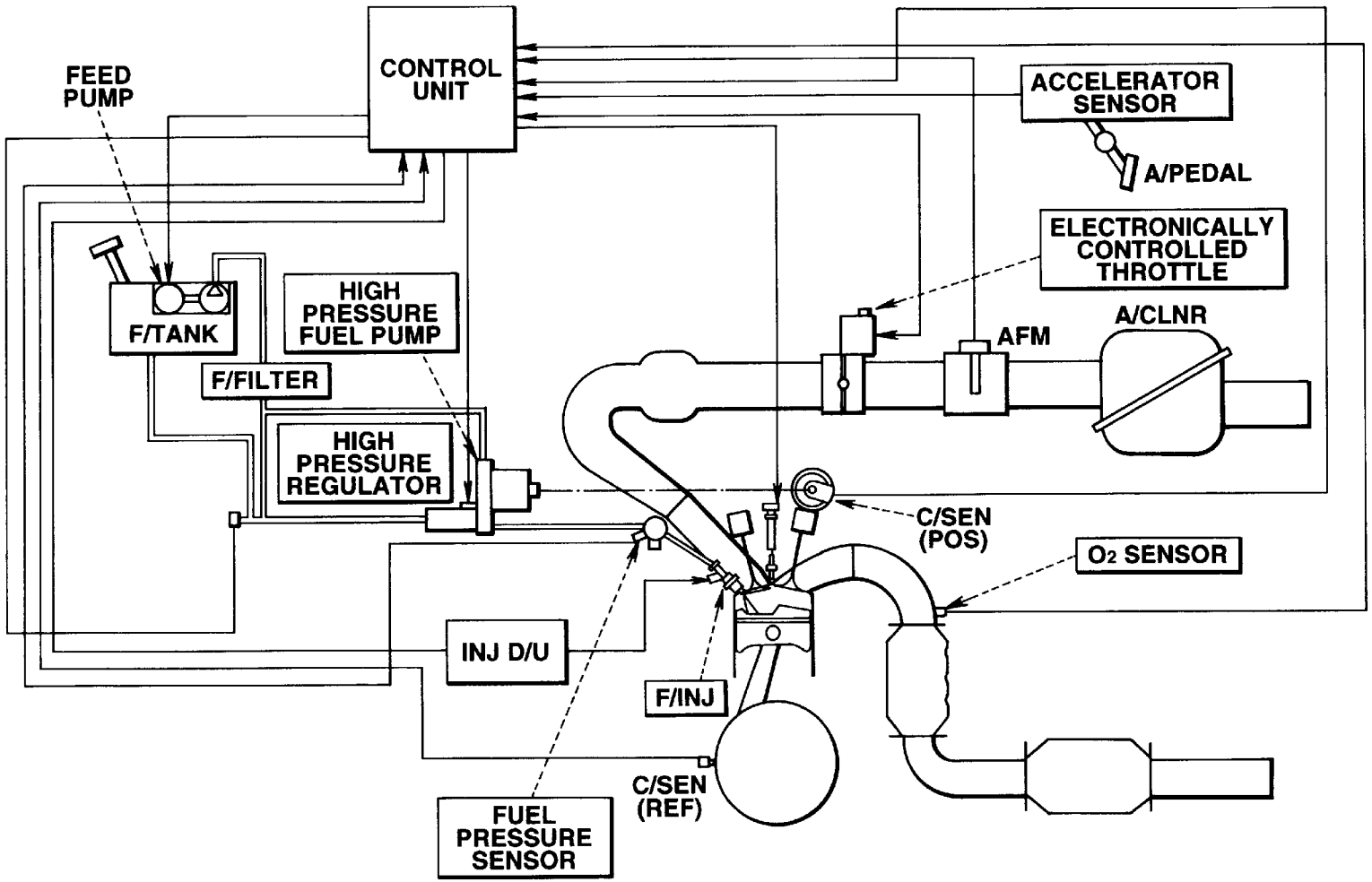
FIG. 6 is a schematic view showing one practical example of an engine system according to the embodiment of the present invention.

FIG. 6 shows, as a more practical example, an engine system which is almost the same as the system shown in FIG. 1. The engine system of FIG. 6 comprises a fuel tank (F/TANK), a feed pump (or low pressure fuel pump) driven by an electric motor, a high pressure fuel pump driven by a cam shaft of the engine, a high pressure regulator for controlling the fuel pressure in response to a fuel pressure control signal sent from a control unit, at least one fuel injector (F/INJ), and at least one spark plug, as in the engine system of FIG. 1. A crank angle sensor has a unit for producing a POS signal to signal each unit crank angle, and a unit for producing a REF signal for signaling each angular displacement of a predetermined crank angle. FIG. 6 further shows an injector drive unit (INJ D/U) for driving the fuel injector, an accelerator pedal (A/PEDAL) operated by a driver of the vehicle, an accelerator position sensor for sensing a depression degree of the accelerator pedal, an electronically controlled throttle valve unit for controlling the intake air quantity, an air cleaner (A/CLNR), an air flow meter (AFM), and an $O_2$ sensor. The control unit performs the control and diagnostic routines of FIGS. 2 and 3 in the same manner as the control unit 17 of FIG. 1.

Figure 7:
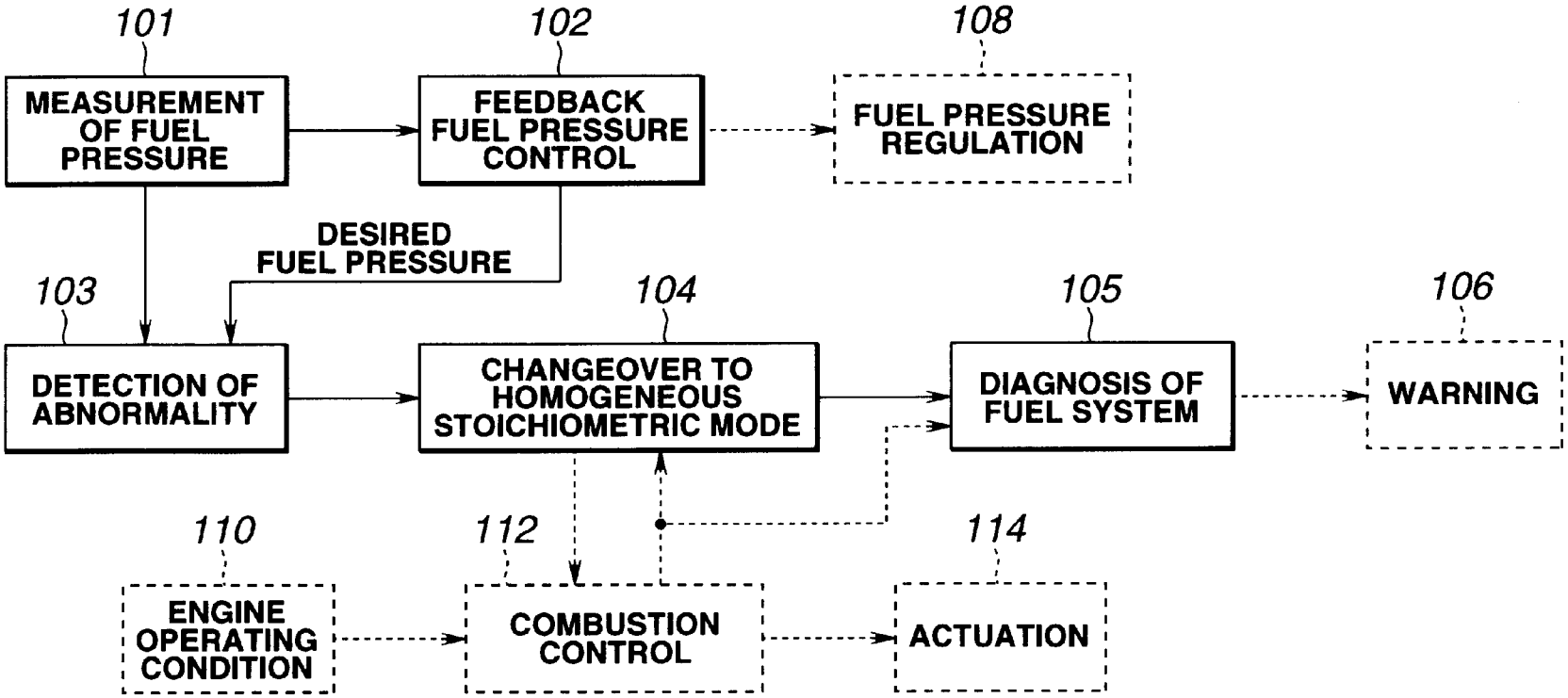
FIG. 7 is a block diagram showing a diagnostic control system formed by the control unit shown in FIG. 1.

The engine system of FIG. 1 (or FIG. 6) can be regarded as a control system as shown in FIG. 7.

A section 101 is an input section for measurement of an actual fuel pressure (FP) supplied to a fuel injector for an engine. The section 101 corresponds to the step S2. The pressure measuring section 101 may comprise the fuel pressure sensor 20.

A pressure controlling section 102 produces a feedback fuel pressure control signal to reduce a pressure deviation of the sensed (or measured) actual fuel pressure (FP) from a desired fuel pressure (tFP). The section 102 corresponds to the step S3. The pressure controlling section 102 may comprises a first subsection for determining the desired fuel pressure in accordance with one or more engine operating condition by receiving input information from engine operating condition sensors, a second subsection for determining a pressure deviation of the sensed actual fuel pressure from the desired fuel pressure by receiving the actual fuel pressure signal from the section 101 and the desired fuel pressure signal from the first subsection, and a third subsection for producing the feedback fuel pressure control signal in accordance with the pressure deviation determined by the second subsection. The first subsection corresponds to the step S1, and the second and third subsection correspond to the step S3.

An abnormality detecting section 103 detects abnormality in the fuel system of the engine by monitoring a settling condition of the actual fuel pressure toward the desired fuel pressure. The abnormality detecting section 103 corresponds to the steps S11 and S12.

A richer combustion mode effecting section 104 functions to cause a combustion changeover to a richer combustion mode such as the homogeneous stoichiometric combustion mode if the abnormality is detected and the engine operation is not in the richer combustion mode. Preferably, the richer mode effecting section 104 causes a feedback stoichiometric air fuel ratio control of a homogeneous stoichiometric charge combustion mode to be performed if the abnormality is detected. The section 104 corresponds to the step S13.

A diagnosing section 105 judges whether the abnormality is attributable to the pressure measuring section 101, by monitoring a parameter, such as a deviation of the air fuel ratio, indicative of control behavior of the feedback stoichiometric air fuel control in the homogeneous stoichiometric combustion mode. The section 105 corresponds to the steps S15~S17.

The control system may further comprise one or more of the following sections, as shown in FIG. 7.

An output section or output device 106 receives the result of the diagnosis from the section 105. The output section 106 may be in the form of a warning indicator or warning device for providing visible or audible warning message about the result of the diagnosis of the section 105. Alternatively, or in addition to the warning device, the output section 106 may comprise one or more components forming a fail-safe system or another engine or vehicle control system for controlling the engine or vehicle so as to adapt the engine or vehicle operating conditions to the abnormal condition determined by the section 105. Moreover, the output section 106 may comprise a memory device for storing information about the result of the diagnosis supplied from the section 105.

An actuating section 108 varies or regulates the fuel pressure in response the fuel pressure control signal delivered from the fuel pressure controlling section 102. In the example of FIG. 1, the actuating section 108 comprises at least the high pressure fuel regulator 16. The actuating section 108 corresponds to the step S4. For example, the actuating section 108 comprises the high pressure regulator 16, or only the duty solenoid of the high pressure regulator 16, or the combination of the high pressure pump and regulator 14 and 16.

An input section 110 comprises one or more engine operating sensors and collects input information about one or more engine operating conditions to determine engine operating parameters indicative of engine load and engine speed, for example. The input section 110 may comprise one or more of the crank angle sensor, the accelerator position sensor, and the air flow sensor.

A combustion control section 112 is for controlling the combustion in the engine in accordance with the input information collected by the input section 110 and the fuel pressure measuring section 101. For example, the combustion control section 112 changes over the engine combustion mode between a first combustion mode and the homogeneous stoichiometric combustion mode by changing a desired target fuel/air ratio (or a desired target equivalent ratio) in accordance with the engine operating parameters. The first combustion mode may be a stratified charge combustion mode, or a homogeneous lean combustion mode or some other lean combustion mode. Specifically, the control section 112 serves as a lambda controller for feedback-controlling the fuel air ratio of the air fuel mixture supplied to, or produced in, the engine.

A section 114 comprise one or more actuators for varying the fuel air ratio, and for achieving a combustion changeover between a first combustion mode such as the stratified charge combustion mode and a second combustion mode such as the homogeneous charge combustion mode by changing the fuel injection quantity, the intake air quantity and the injection timing, for example.

If the actual fuel pressure is not settled down to the desired fuel pressure, the control system of FIG. 7 according to the present invention judges that an abnormal condition has occurred in the fuel pressure sensor or in the fuel pressure control system, and changes over the engine combustion mode to the richer combustion mode, such as the homogeneous stoichiometric charge combustion mode, in which the feedback air fuel ratio control is performed to a richer ratio level. By changing over the combustion mode from the leaner combustion mode such as the stratified charge combustion mode or the homogeneous lean combustion mode, to the richer combustion mode such as the homogeneous stoichiometric mode, the control system can protect stable combustion against abnormality.

When the deviation of the sensed actual air fuel ratio from the desired richer ratio such as the stoichiometric ratio during engine operation in the richer mode such as the homogeneous stoichiometric mode is large, the control system judges that there is a malfunction in the fuel pressure sensor. Abnormality in the signal of the fuel pressure sensor makes the calculation of the fuel injection quantity inadequate, and hence increases the deviation of the air fuel ratio. If, on the other hand, the deviation of the air fuel ratio is small or null, then the control system judges that there is a malfunction in the fuel pressure control system.

The present invention is advantageous when applied to an in-cylinder direct injection engine in which higher fuel pressure is needed for the stratified combustion mode injection on the compression stroke, and the feedback control of the fuel pressure is important to adapt the fuel pressure to a desired fuel pressure varying in dependence on engine operating conditions. However, the present invention is not limited to the in-cylinder direct injection engine. The present invention is also applicable to a lean burn engine, for example.

The present application is based on a Japanese Patent Application No. 9-232007. The entire contents of Japanese Patent Application No. 9-232007 with a filing date of Aug. 28, 1997 are hereby incorporated by reference.

What is claimed is:

1. A diagnostic control method for detecting malfunction in a fuel system for a fuel injection type internal combustion engine, the method comprising;

a pressure sensing step of sensing an actual fuel pressure with a fuel pressure sensor;

a pressure controlling step of performing a feedback fuel pressure control to reduce a pressure deviation of the actual fuel pressure sensed by the fuel pressure sensor from a desired fuel pressure;

an abnormality detecting step of detecting abnormality in the fuel system by monitoring the actual fuel pressure;

a richer combustion mode effecting step of effecting a feedback air fuel ratio control in a predetermined richer combustion mode if the abnormality is detected; and a diagnosing step of judging whether to attribute the abnormality to the fuel pressure sensor, by monitoring performance of the feedback air fuel control in the richer combustion mode.

2. The diagnostic method according to claim 1 wherein the predetermined richer combustion mode is a homogeneous stoichiometric charge combustion mode, the pressure sensing step is carried out by sensing the actual fuel pressure in a fuel delivery passage for supplying fuel from a fuel pump to a fuel injector, the abnormality detecting step is carried out by checking whether the sensed fuel pressure is settled down to the desired fuel pressure and judging that the abnormality exists when the sensed fuel pressure is not settled down to the desired fuel pressure, and the diagnosing step is carried out by discriminating a malfunction in the fuel pressure sensor from a malfunction nonattributable to the fuel pressure sensor in accordance with a ratio deviation of an actual air fuel ratio from a theoretical air fuel ratio.

3. The diagnostic method according to claim 1 wherein the abnormality detecting step is carried out by monitoring the pressure deviation of the actual fuel pressure from the desired fuel pressure, and the diagnosing step is carried out by monitoring a signal produced in the feedback air fuel ratio control.

4. The diagnostic method according to claim 3 wherein the richer combustion mode is a homogeneous stoichiometric charge combustion mode and wherein the diagnosing step is carried out by monitoring a control parameter which is one of a ratio deviation of an actual air fuel ratio from a desired air fuel ratio of the richer combustion mode and a feedback correction quantity of the feedback air fuel control.

5. The diagnostic method according to claim 4 wherein the richer combustion mode effecting step is carried out by forcibly changing over engine operation from a lean combustion mode to the homogeneous stoichiometric combustion mode if the abnormality is detected.

6. The diagnostic method according to claim 5 wherein the lean combustion mode comprises a stratified charge combustion mode.

7. The diagnostic method according to claim 4 wherein, in the abnormality detecting step, an abnormality signal indicating abnormality in the fuel system is produced when the pressure deviation of the sensed fuel pressure from the desired fuel pressure remains outside a predetermined normal range for a time duration equal to or longer than a predetermined time length.

8. The diagnostic method according to claim 7 wherein the abnormality detecting step comprises a step of comparing the pressure deviation with a predetermined deviation value to determine whether the pressure deviation is outside the normal range, and the predetermined deviation value is varied in accordance with the desired fuel pressure.

9. The diagnostic method according to claim 4 wherein the diagnosing step comprises a step of producing a first warning signal indicative of malfunction in the fuel pressure sensor when the feedback correction quantity of the air fuel ratio control is fixed to one of predetermined upper and lower limit values, and otherwise producing a second warning signal indicating that the abnormality is not attributable to the fuel pressure sensor.

10. The diagnostic method according to claim 4 wherein the diagnosing step comprises a step of determining whether the pressure deviation is positive, and whether a correction quantity deviation of the feedback correction quantity from a predetermined reference value is positive, and producing a first warning signal when one of the pressure deviation and the correction quantity deviation is negative and the other of the pressure deviation and the correction quantity deviation is positive, and a second warning signal when the pressure deviation and the correction quantity deviation are both positive, and when the pressure deviation and the correction quantity deviation are both negative.

11. A diagnostic control system for detecting malfunction in a fuel system for a fuel injection type internal combustion engine, comprising:

a fuel pressure sensor for sensing an actual fuel pressure for the engine;

a pressure controlling section for performing a feedback fuel pressure control to reduce a pressure deviation of the actual fuel pressure sensed by the fuel pressure sensor from a desired fuel pressure;

an abnormality detecting section for detecting abnormality in the fuel system by monitoring the actual fuel pressure;

a richer combustion mode effecting section for effecting a feedback air fuel ratio control in a predetermined richer combustion mode if the abnormality is detected; and a diagnosing section of judging whether the abnormality is attributable to the fuel pressure sensor, by monitoring performance of the feedback air fuel control in the richer combustion mode.

12. The diagnostic control system according to claim 11 wherein the richer combustion mode is a homogeneous stoichiometric charge combustion mode, the abnormality detecting section monitors the pressure deviation of the actual fuel pressure from the desired fuel pressure and produces an abnormality signal indicating abnormality in the fuel system when the pressure deviation of the sensed fuel pressure from the desired fuel pressure remains outside a predetermined normal range for a time duration equal to or longer than a predetermined time length, and the diagnosing section monitors a control parameter which is one of a ratio deviation of an actual air fuel ratio from a theoretical air fuel ratio and a feedback correction quantity of the feedback air fuel control.

13. The diagnostic control system according to claim 12 wherein the diagnosing section produces a first warning signal indicative of malfunction in the fuel pressure sensor when the feedback correction quantity of the air fuel ratio control remains outside a predetermined normal range one-sidedly for a duration equal to or longer than a predetermined time length, and otherwise producing a second warning signal indicating that the abnormality is not attributable to the fuel pressure sensor.

14. The diagnostic control system according to claim 12 wherein the richer mode effecting section forcibly changes over engine operation from a lean combustion mode to the homogeneous stoichiometric combustion mode when the abnormality is detected, and wherein the system further comprises an output device for receiving the first and second warning signals, and wherein the output device is a warning indicator.

15. The diagnostic system according to claim 12 wherein the fuel pressure sensor is arranged to sense the fuel pressure in a fuel delivery passage for supplying fuel under pressure from a high pressure fuel pump to a fuel injector for injecting fuel directly into a combustion chamber of the engine.

16. An engine system comprising:

an internal combustion engine;

a fuel system comprising a fuel injector for supplying fuel to the engine, and a fuel pump for supplying the fuel under pressure to the fuel injector through a fuel delivery circuit;

a first input device for producing a first input signal representing a sensed actual fuel pressure in the fuel delivery circuit; and a controller for performing a feedback fuel pressure control to reduce a pressure deviation of the sensed actual fuel pressure from a desired target fuel pressure (tFP), for detecting abnormality in the fuel system by monitoring the pressure deviation, for commanding a changeover of combustion in the engine from a lean combustion mode to a richer combustion mode to effect a feedback air fuel ratio control if the abnormality is detected, and for judging whether the abnormality is attributable to the fuel pressure sensor, by monitoring a feedback correction quantity of the feedback air fuel control in the richer or combustion mode.

17. The engine system according to claim 16 wherein the richer combustion mode is a homogeneous stoichiometric combustion mode, the system further comprises a second input device for producing a second input signal representing an engine operating condition of the engine, and a third input device for determining an actual air fuel ratio of the engine, and the controller is configured to change over an engine operating mode between the first combustion mode and the homogeneous stoichiometric charge combustion mode in accordance with the engine operating condition by controlling the fuel injection system, and to perform a feedback stoichiometric air fuel ratio control to reduce a ratio deviation of the actual air fuel ratio from a theoretical air fuel ratio toward zero when the engine is operated in the homogeneous stoichiometric mode, and wherein the first combustion mode is a stratified charge combustion mode.

18. The engine system according to claim 17 wherein the fuel system comprises the fuel injector for injecting the fuel directly into a combustion chamber of the engine, the fuel pump which is a high pressure pumpdriven by the engine, a high pressure regulator for regulating the fuel pressure supplied to the fuel injector in response to a pressure control signal produced by the controller, a fuel tank, a low pressure fuel pump driven by an electric motor, for supplying the fuel from the tank to the high pressure pump.

19. The engine system according to claim 17 wherein the controller produces a first warning signal indicative of malfunction in the fuel pressure sensor when the feedback correction quantity of the feedback stoichiometric air fuel ratio control remains outside a predetermined normal range on one side of the predetermined normal range for a time duration equal to or longer than a predetermined time length, and otherwise the controller produces a second warning signal indicating that the abnormality is not attributable to the fuel pressure sensor, and wherein the system further comprises an output device for receiving the first and second warning signals.

20. The engine system according to claim 19 wherein the output device comprises a warning indicator for providing perceptible diagnostic message in response to one of the first and second warning signals.

* * * * *